US006850192B2

(12) United States Patent
Yeh

(10) Patent No.: US 6,850,192 B2
(45) Date of Patent: Feb. 1, 2005

(54) PLANAR L-SHAPED ANTENNA OF DUAL FREQUENCY

(75) Inventor: Ming-Hau Yeh, Hsinchu (TW)

(73) Assignee: D-Link Corporation, Hsinchu (TW)

( * ) Notice: Subject to any disclaimer, the term of this patent is extended or adjusted under 35 U.S.C. 154(b) by 15 days.

(21) Appl. No.: 10/403,278

(22) Filed: Apr. 1, 2003

(65) Prior Publication Data

US 2004/0196189 A1 Oct. 7, 2004

(51) Int. Cl.[7] ..... H01Q 1/38
(52) U.S. Cl. ..... 343/700 MS; 343/846
(58) Field of Search ..... 343/700 MS, 795, 343/846, 848, 702

(56) References Cited

U.S. PATENT DOCUMENTS 4,063,246 A * 12/1977 Greiser ..... 343/700 MS
5,828,340 A * 10/1998 Johnson ..... 343/700 MS
6,747,600 B2 * 6/2004 Wong et al. ..... 343/700 MS

* cited by examiner

*Primary Examiner*—Hoang V. Nguyen
(74) *Attorney, Agent, or Firm*—Bacon & Thomas, PLLC

(57) ABSTRACT

A planar L-shaped antenna. The antenna is operable at two different frequency ranges and includes a patch line printed on top of a dielectric substrate and has one end formed as a signal feed point. A ground metal plate is printed on a bottom of the dielectric substrate. First and second radiating elements extend oppositely from another end of the patch line. The first and second radiating elements are perpendicular to the patch line and disposed above and beyond the ground metal plate for receiving signals having different frequencies respectively.

8 Claims, 8 Drawing Sheets

PLANAR L-SHAPED ANTENNA OF DUAL FREQUENCY

FIELD OF THE INVENTION

The present invention relates to antennas and more particularly to an improved planar L-shaped antenna capable of operating at two different frequency ranges.

BACKGROUND OF THE INVENTION

A conventional sleeve (or L-shaped) antenna mounted in a wireless communication device is illustrated in FIG. 1. As shown, the antenna comprises a coaxial transmission line 10 including an inner conductor (or core) 14, an outer conductor (or shielded mesh or ground line) 16, and a cylinder 17 of insulated dielectric material sandwiched between the inner and outer conductors 14 and 16 so that a concentric conductor as known in the electromagnetism is formed by both the inner and outer conductors 14 and 16. Moreover, an insulated shell 19 is formed around the coaxial transmission line 10. The coaxial transmission line 10 has one end coupled to a control circuit (not shown) of the wireless communication device so that the coaxial transmission line 10 can be served as a feed line. A ground metal plate 18 is formed on the other end of the coaxial transmission line 10. The ground metal plate 18 is coupled to the outer conductor 16 so as to electrically ground the outer conductor 16 of the coaxial transmission line 10. An extension 12 is formed from the inner conductor 14 at the other end of the coaxial transmission line 10. The extension 12 is shaped like an inverted L shape and extends beyond the ground metal plate 18. A length of the inverted L-shaped extension (i.e., radiating element) 12 is closely related to a resonant frequency of the antenna which is typically operated at a single frequency.

For making the L-shaped antenna more compact, a technique of manufacturing the antenna on a printed circuit board is adopted by some manufacturers in the art as shown in FIG. 2. The L-shaped antenna comprises a dielectric substrate 27, a patch line 24 printed on the top of the dielectric substrate 27, the patch line 24 having one end formed as a signal feed point 241, a ground metal plate 28 printed on the bottom of the dielectric substrate 27 opposite to the patch line 24, and an inverted L-shaped radiating element 242 formed at the other end of the patch line 24, the inverted L-shaped radiating element 242 being extended in a direction perpendicular to the patch line 24 above and beyond the ground metal plate 28. A length of the inverted L-shaped radiating element 242 is closely related to a resonant frequency of the antenna which is typically operated at a single frequency.

Further, for the purpose of using a coplanar wave guide as a feed line, another technique of manufacturing the L-shaped antenna on a printed circuit board is adopted by some manufacturers in the art as shown in FIG. 3. The coplanar wave guide based L-shaped antenna comprises a dielectric substrate 37, a coplanar wave guide line 34 printed on the top of the dielectric substrate 37, the coplanar wave guide line 34 having one end formed as a signal feed point 341, two spaced ground metal plates 38 printed on the top of the dielectric substrate 37 (i.e., the same surface as the coplanar wave guide line 34) with the coplanar wave guide line 34 located therebetween and spaced apart, and an inverted L-shaped radiating element 342 formed at the other end of the coplanar wave guide line 34, the inverted L-shaped radiating element 342 being extended in a direction perpendicular to the coplanar wave guide line 34 and beyond the ground metal plates 38. A length of the inverted L-shaped radiating element 342 is closely related to a resonant frequency of the antenna which is typically operated at a single frequency.

There has been a significant growth in wireless local Area network (WLAN) due to an increasing demand of mobile communication products in recent years in which IEEE 802.11 WLAN protocol is the most important one among a variety of WLAN standards. The IEEE 802.11 WLAN protocol was established in 1997. The IEEE 802.11 WLAN protocol not only provides many novel functions for WLAN based communication but also proposes a solution for communicating between mobile communication products made by different manufacturers. There is no doubt that the use of the IEEE 802.11 WLAN protocol is a milestone in the development of WLAN. The IEEE 802.11 WLAN protocol was further modified for being adapted to serve as a standard of both IEEE/ANSI and ISO/IEC in August 2000. The modifications comprise IEEE 802.11a WLAN protocol and IEEE 802.11b WLAN protocol. In an expanded standard physical layer, the operating frequencies have to be set at 5 GHz and 2.4 GHz. As such, the well-known L-shaped antenna cannot satisfy the requirement of enabling a mobile communication product to use both IEEE 802.11a and IEEE 802.11b WLAN protocols at the same time. Instead, several antennas have to be mounted in the product for complying with the requirement of frequency band. However, such can increase a manufacturing cost, complicate an installation procedure, and consume precious space for mounting the antennas. As a result, the size of the product cannot be reduced, thereby contradicting the compactness trend.

SUMMARY OF THE INVENTION

A primary object of the present invention is to provide a planar L-shaped antenna of dual frequency for fulfilling the need of multi-frequency operation which is unobtainable by a conventional antenna only operated at a single frequency.

One object of the present invention is to provide a planar L-shaped antenna operable at two different frequency ranges comprising a dielectric substrate; a patch line printed on a top of the dielectric substrate, the patch line having one end formed as a signal feed point; a ground metal plate printed on a bottom of the dielectric substrate; first and second radiating elements extended oppositely from the other end of the patch line and being perpendicular to the patch line. The patch line and the radiating elements together form an antenna having a shape of T As an end, the radiating elements are capable of receiving signals having different frequencies.

Another object of the present invention is to provide a planar L-shaped antenna operable at two different frequency ranges comprising a dielectric substrate; a coplanar wave guide line printed on a top of the dielectric substrate, the coplanar wave guide line having one end formed as a signal feed point; two spaced ground metal plates printed on the top of the dielectric substrate with the coplanar wave guide line located therebetween and spaced apart; first and second radiating elements extended oppositely from the other end of the patch line and being perpendicular to the patch line. The patch line and the radiating elements together form an antenna having a shape of T As an end, the radiating elements are capable of receiving signals having different frequencies.

In one aspect of the present invention a length of each of the first and the second radiating elements extended oppositely from the coplanar wave guide line or the patch line beyond the ground metal plate is about one-quarter wavelength at each operating frequency of the frequency ranges so that the first and the second radiating elements are capable of receiving signals of dual frequency as stipulated by IEEE 802.11a protocol and IEEE 802.11b protocol respectively.

The above and other objects, features and advantages of the present invention will become apparent from the following detailed description taken with the accompanying drawings.

DETAILED DESCRIPTION OF THE PREFERRED EMBODIMENTS

Figure 1:
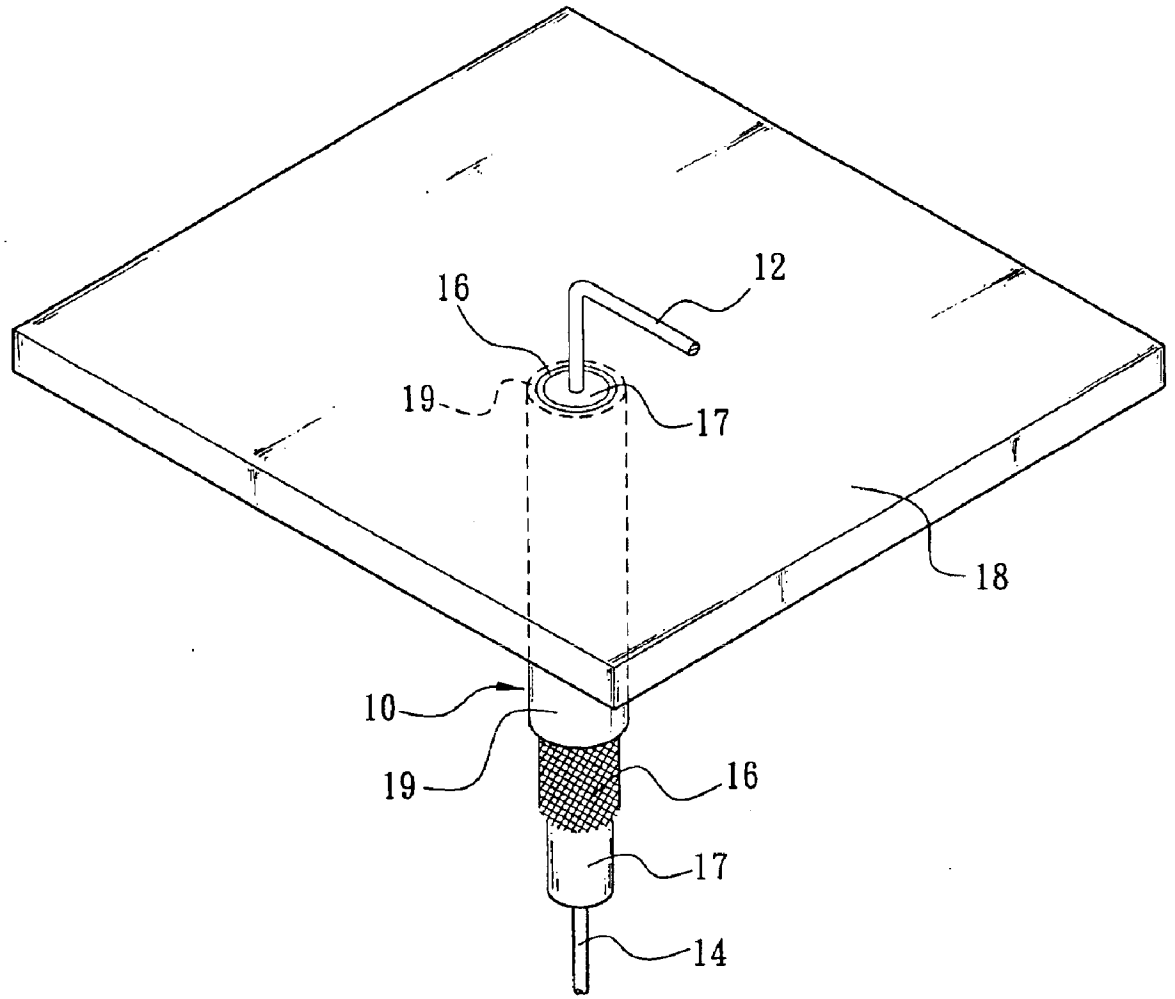
FIG. 1 (Prior Art)
FIG. 1 is a perspective view of a conventional sleeve antenna.
Figure 2:
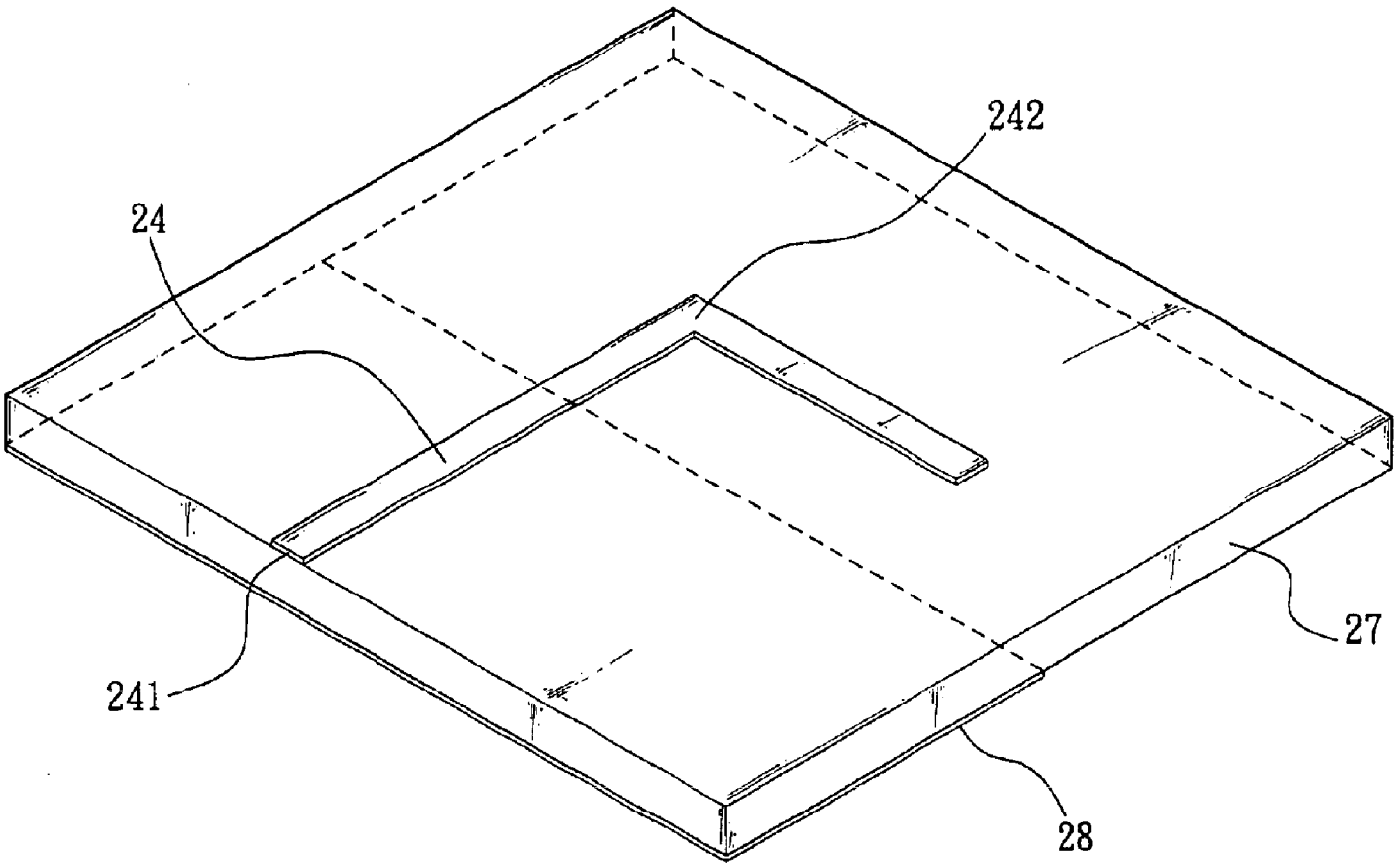
FIG. 2 (Prior Art)
FIG. 2 is a perspective view of a conventional patch based L-shaped antenna.
Figure 3:
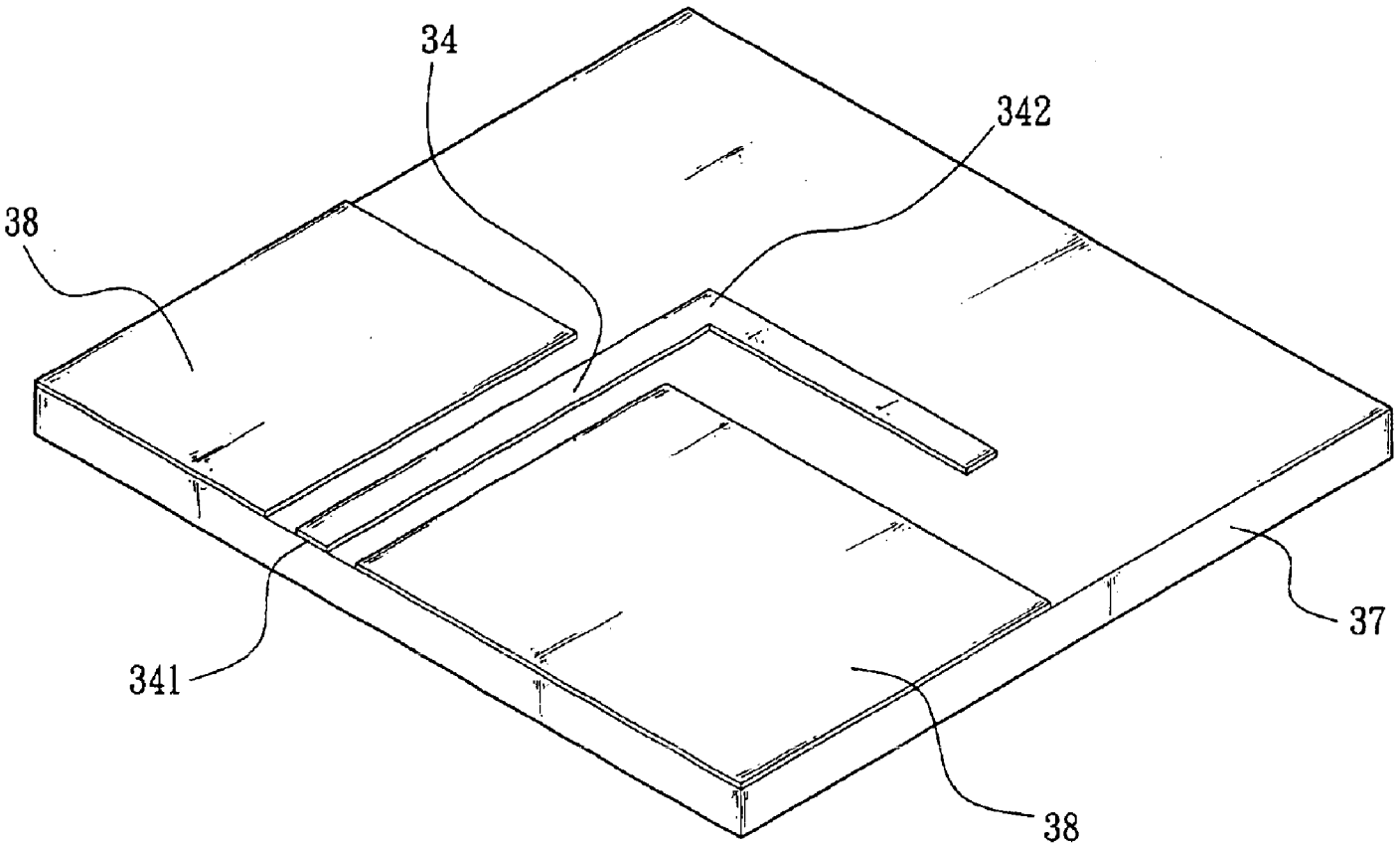
FIG. 3 (Prior Art)
FIG. 3 is a perspective view of a conventional coplanar wave guide based L-shaped antenna.
Figure 4:
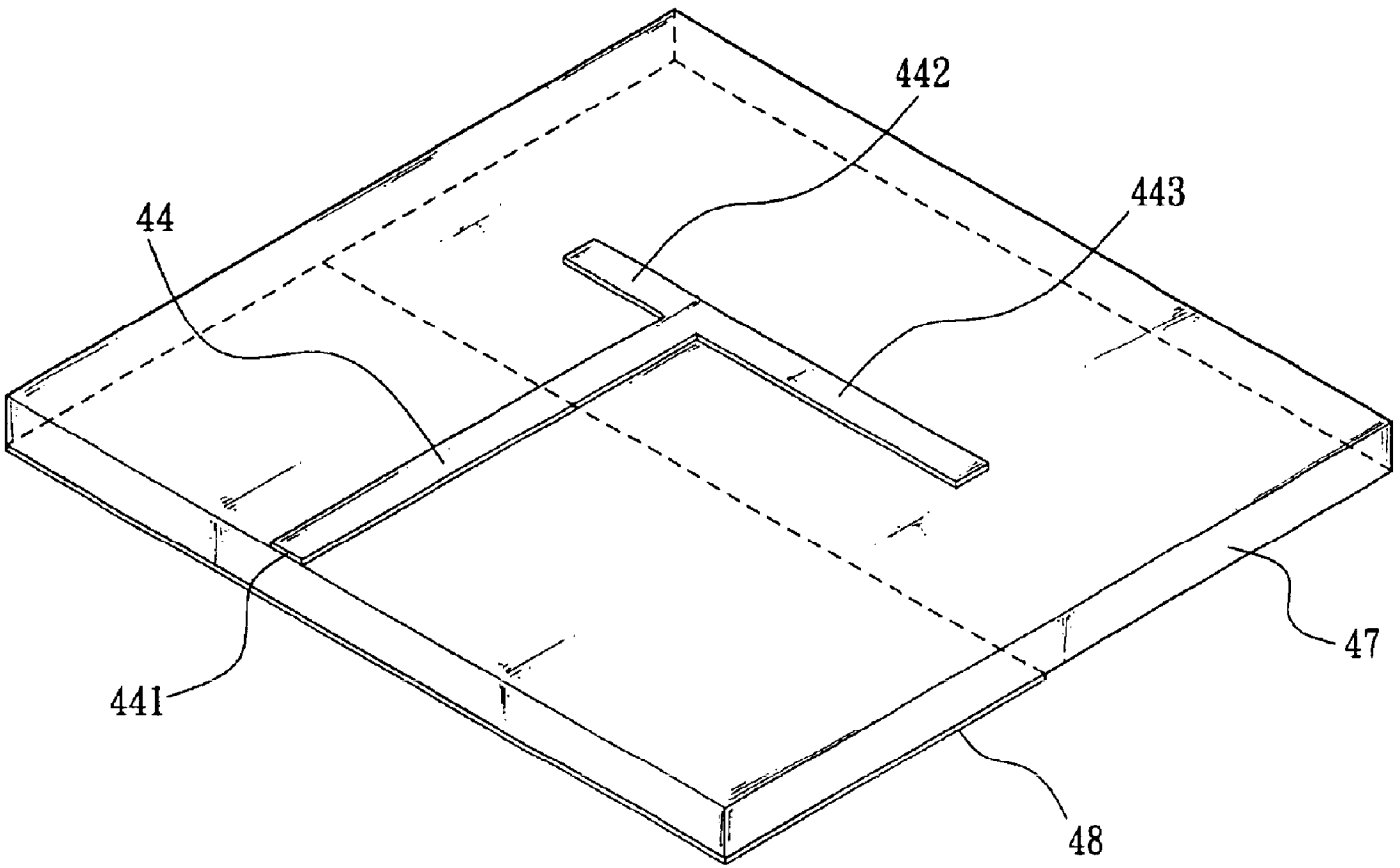
FIG. 4 is a perspective view of a first preferred embodiment of planar L-shaped antenna of dual frequency according to the invention.

Referring to FIG. 4, there is shown a planar L-shaped antenna of dual frequency in accordance with a first preferred embodiment of the invention. The antenna comprises a dielectric substrate 47, a patch line 44 printed on the top of the dielectric substrate 47, the patch line 44 having one end formed as a signal feed point 441, a ground metal plate 48 printed on the bottom of the dielectric substrate 47 opposite to the patch line 44, and first and second radiating elements 442, 443 extended oppositely from the other end of the patch line 44 and being perpendicular to the patch line 44. The patch line 44 and the radiating elements 442, 443 together form an antenna having a shape of T As an end, the radiating elements 442, 443 are capable of receiving signals having different frequencies.

In the first preferred embodiment, the radiating elements 442, 443 are designed to receive signals having different frequencies. Hence, a length of each of the radiating elements 442, 443 extended oppositely from the patch line 44 above the ground metal plate 48 is closely related to a distinct resonant frequency of a corresponding antenna. In the first preferred embodiment of the invention, preferably, a length of each of the radiating elements 442, 443 extended oppositely from the patch line 44 above and beyond the ground metal plate 48 is about one-quarter wavelength at each operating frequency of two frequency ranges in which the longer radiating element 443 is used as a radiating element operated at a low frequency and the shorter radiating element 442 is used as a radiating element operated at a high frequency respectively. As an end, the radiating elements 442, 443 of different lengths can receive signals of dual frequency as stipulated by IEEE 802.11a protocol and IEEE 802.11b protocol respectively.

Figure 5:
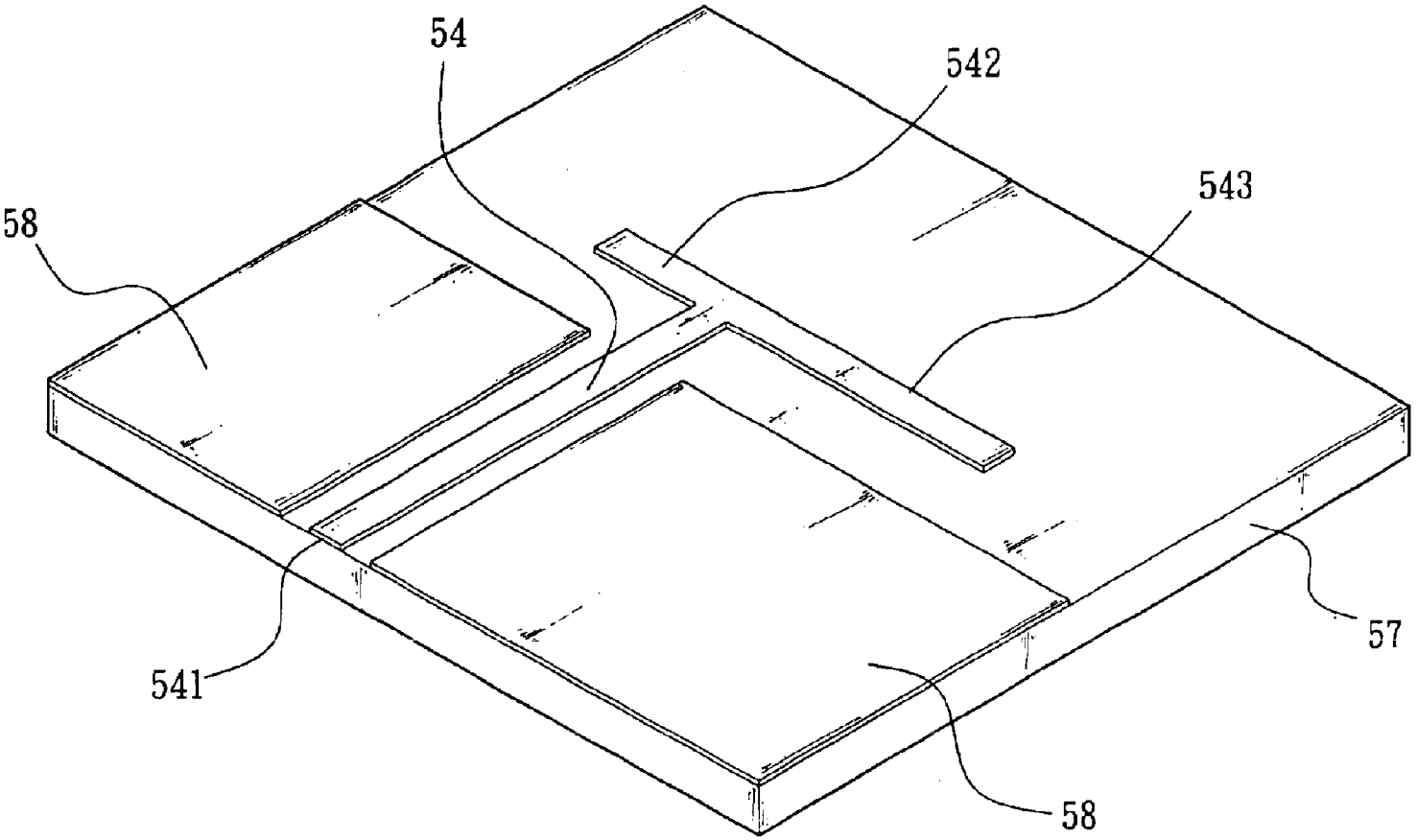
FIG. 5 is a perspective view of a second preferred embodiment of planar L-shaped antenna of dual frequency according to the invention.

Referring to FIG. 5, there is shown a planar L-shaped antenna of dual frequency in accordance with a second preferred embodiment of the invention. The antenna comprises a dielectric substrate 57, a coplanar wave guide line 54 printed on the top of the dielectric substrate 57, the coplanar wave guide line 54 having one end formed as a signal feed point 541, two spaced ground metal plates 58 printed on the top of the dielectric substrate 57 (i.e., the same surface as the coplanar wave guide line 54) with the coplanar wave guide line 54 located therebetween and spaced apart, and first and second radiating elements 542, 543 extended oppositely from the other end of the coplanar wave guide line 54 and being perpendicular to the coplanar wave guide line 54. The coplanar wave guide line 54 and the radiating elements 542, 543 together form an antenna having a shape of T As an end, the radiating elements 542, 543 are capable of receiving signals having different frequencies.

In the second preferred embodiment, the radiating elements 542, 543 are designed to receive signals having different frequencies. Hence, a length of each of the radiating elements 542, 543 extended oppositely from the coplanar wave guide line 54 above the ground metal plates 58 is closely related to a distinct resonant frequency of a corresponding antenna. In the second preferred embodiment of the invention, preferably, a length of each of the radiating elements 542, 543 extended oppositely from the coplanar wave guide line 54 beyond the ground metal plates 58 is about one-quarter wavelength at each operating frequency of two frequency ranges in which the longer radiating element 543 is used as a radiating element operated at a low frequency and the shorter radiating element 542 is used as a radiating element operated at a high frequency respectively. As an end, the radiating elements 542, 543 of different lengths can receive signals of dual frequency as stipulated by IEEE 802.11a protocol and IEEE 802.11b protocol respectively.

Figure 6:
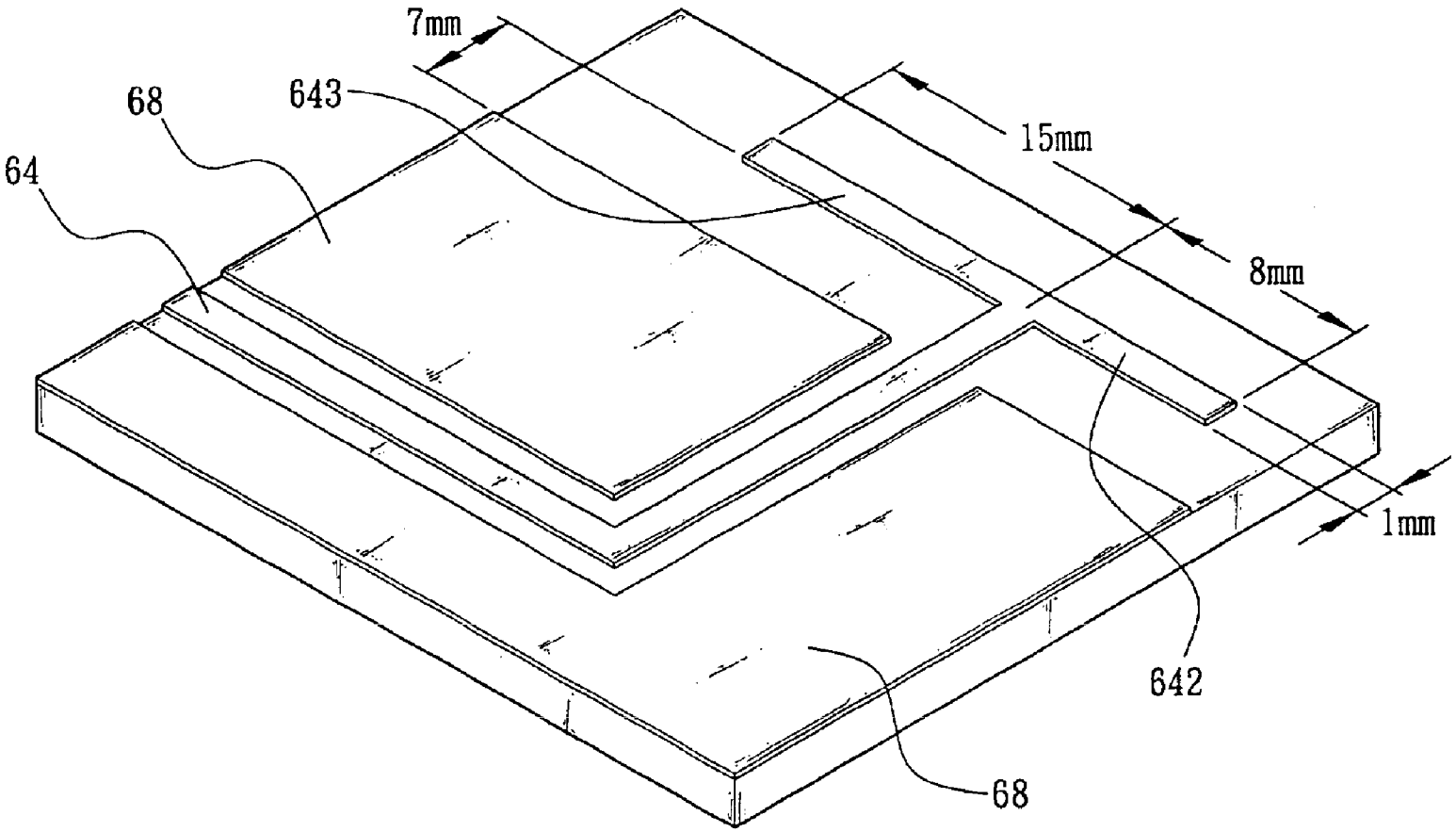
FIG. 6 is a perspective view of a third preferred embodiment of planar L-shaped antenna of dual frequency according to the invention.
Figure 7:
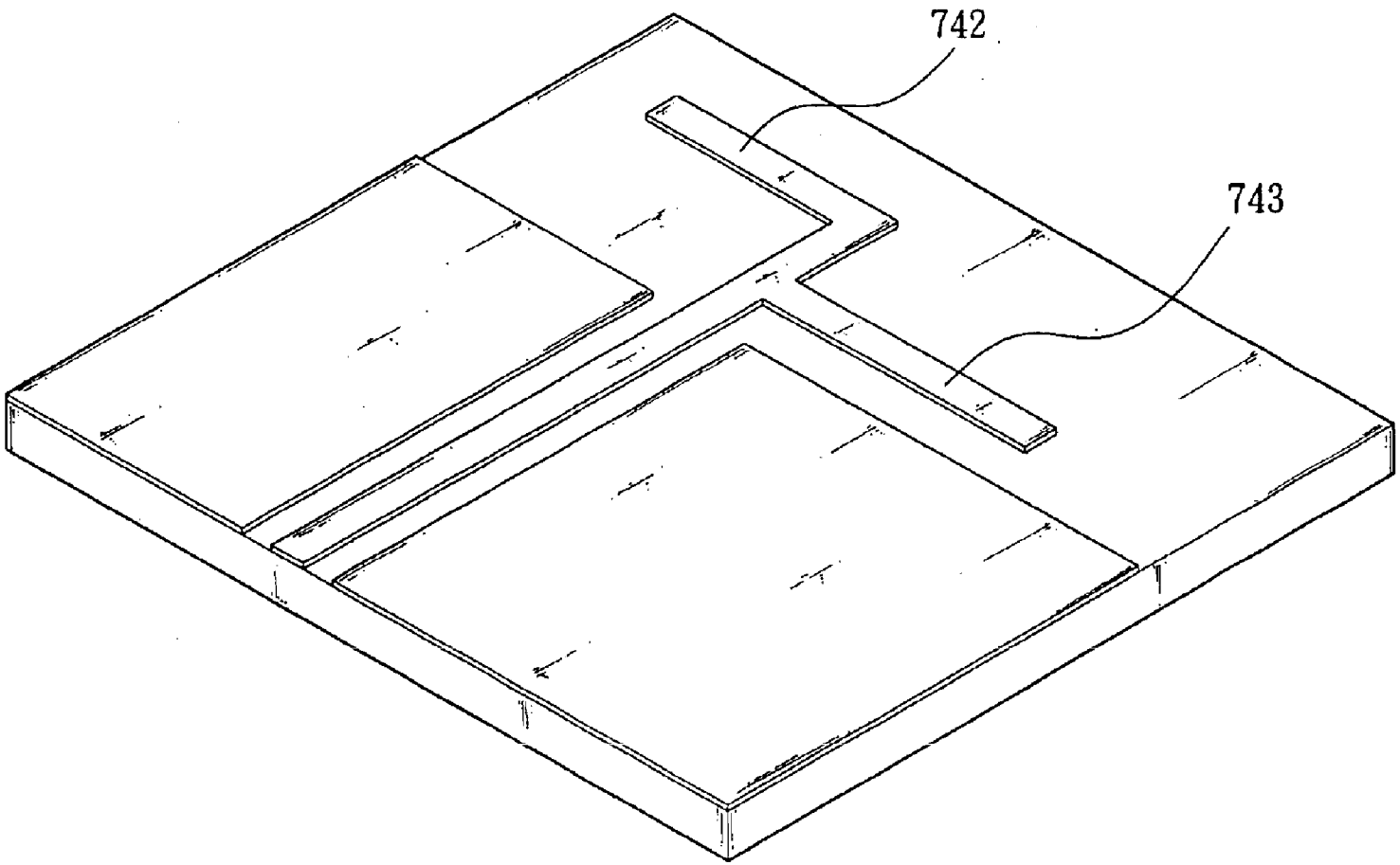
FIG. 7 is a perspective view of a fourth preferred embodiment of planar L-shaped antenna of dual frequency according to the invention.

Referring to FIGS. 4 and 5 again, in the above preferred embodiments the patch line 44 or the coplanar wave guide line 54 is an elongated, straight line. But in practice the patch line 44 or the coplanar wave guide line 54 of the invention can be formed as a bent coplanar wave guide line 64 depending on applications or characteristic matching as shown in a third preferred embodiment of the invention of FIG. 6. Also, pairs of the radiating elements 442, 443 and the radiating elements 542, 543 of the invention are extended oppositely from the same point of the patch line 44 and the coplanar wave guide line 54 as shown in FIG. 4 and FIG. 5 respectively. But in practice the radiating elements can be formed as radiating elements 742, 743 extended oppositely from different points of the patch line 44 or the coplanar wave guide line 54 as shown in a fourth preferred embodiment of the invention of FIG. 7.

Figure 8:
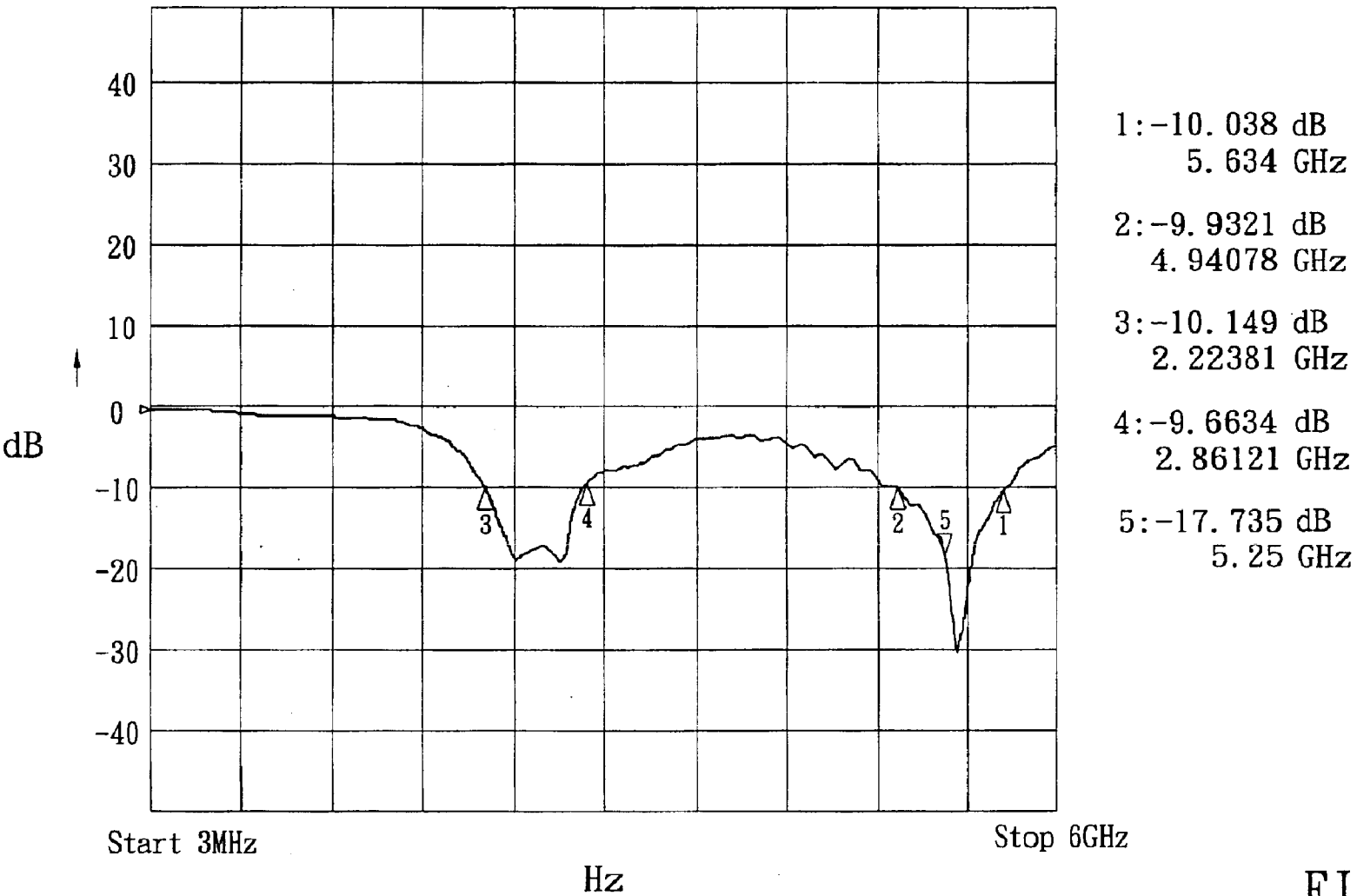
FIG. 8 is a graph showing return loss measured at the antenna of FIG. 6.

In the antenna of the third preferred embodiment of the invention (see FIG. 6), the coplanar wave guide line 64, the radiating elements 642, 643, and the ground metal plates 68 are printed on the top of the dielectric substrate having a thickness about 0.8 mm and a dielectric coefficient from about 4.3 to about 4.7. This forms a planar L-shaped antenna of dual frequency of the invention. Each of the coplanar wave guide line 64 and the radiating elements 642, 643 has a width about 1 mm. A length of the radiating element 643 operated at a low frequency is about 15 mm. A length of the radiating element 642 operated at a high frequency is about 8 mm. A length of the coplanar wave guide line 64 extended beyond the ground metal plates 68 is about 7 mm. The antenna of the third preferred embodiment operates at two frequency ranges from 2.22381 GHz to 2.86121 GHz and from 4.94078 GHz to 5.634 GHz respectively. A return loss measured at each of the frequency ranges is shown in FIG. 8. It is seen that each return loss is less than 9 dB. In view of the measured return loss, the planar L-shaped antenna of dual frequency of the invention can receive signals of dual frequency as stipulated by IEEE 802.11a protocol and IEEE 802.11b protocol respectively.

While the invention has been described by means of specific embodiments, numerous modifications and variations could be made thereto by those skilled in the art without departing from the scope and spirit of the invention set forth in the claims.

What is claimed is:

1. A planar L-shaped antenna, comprising:

a dielectric substrate;

a patch line printed on a top of the dielectric substrate, the path line having one end formed as a signal feed point;

a ground metal plate printed on a bottom of dielectric substrate; and first and second radiating elements operate at two different frequency ranges respectively and extend oppositely from another end of the patch line, the first and the second radiating elements being perpendicular to the patch line and disposed above and beyond the ground metal plate.

2. The planar L-shaped antenna of claim 1, wherein a length of each of the first and the second radiating elements that extends oppositely from the patch line above and beyond the ground metal plate is about one-quarter wavelength at each operating frequency of the frequency ranges.

3. The planar L-shaped antenna of claim 1, wherein the patch line is a bent patch line.

4. The planar L-shaped antenna of claim 1, wherein the first and the second radiating elements are extended oppositely from different points of the patch line and are perpendicular to the patch line.

5. A planar L-shaped antenna, comprising:

a dielectric substrate;

a coplanar wave guide line printed on a top of the dielectric substrate, the coplanar wave guide line having one end formed as a signal feed point;

two spaced ground metal plates printed on the top of the dielectric substrate with the coplanar wave guide line located therebetween and spaced apart; and first and second radiating elements operate at two different frequency ranges respectively and extend oppositely from another end of the coplanar wave guide line, the first and the second radiating elements being perpendicular to the coplanar wave guide line and disposed above and beyond the ground metal plates.

6. The planar L-shaped antenna of claim 5, wherein a length of each of the first and the second radiating elements that extends oppositely from the coplanar wave guide line beyond the ground metal plates is about one-quarter wavelength at each operating frequency of the frequency ranges.

7. The planar L-shaped antenna of claim 5, wherein the patch line is a bent patch line.

8. The planar L-shaped antenna of claim 5, wherein the first and the second radiating elements are extended oppositely from different points of the coplanar wave guide line and are perpendicular to the coplanar wave guide line.

* * * * *